US009272758B2

(12) United States Patent
Dysvik

(10) Patent No.: US 9,272,758 B2
(45) Date of Patent: Mar. 1, 2016

(54) METHOD AND APPARATUS FOR OVERBOARDING OF A SUBSEA STRUCTURE

(71) Applicant: EMAS-AMC AS, Oslo (NO)

(72) Inventor: Jan Dysvik, Snarøya (NO)

(73) Assignee: EMAS-AMC AS, Oslo (NO)

( * ) Notice: Subject to any disclaimer, the term of this patent is extended or adjusted under 35 U.S.C. 154(b) by 0 days.

(21) Appl. No.: 14/514,400

(22) Filed: Oct. 15, 2014

(65) Prior Publication Data

US 2015/0104274 A1 Apr. 16, 2015

(30) Foreign Application Priority Data

Oct. 16, 2013 (NO) ..... 20131373

(51) Int. Cl.

| | |
|---|---|
| ***B63B 35/40*** | (2006.01) |
| ***B63B 27/10*** | (2006.01) |
| ***B63B 27/36*** | (2006.01) |
| ***B63G 8/42*** | (2006.01) |
| ***B63B 27/30*** | (2006.01) |
| ***B63B 43/02*** | (2006.01) |

(52) U.S. Cl.

CPC ..... *B63B 27/10* (2013.01); *B63B 27/30* (2013.01); *B63B 27/36* (2013.01); *B63B 43/02* (2013.01); *B63G 8/42* (2013.01)

(58) Field of Classification Search

CPC ..... B66C 13/04; B66C 13/08; F16L 1/202; F16L 1/19; F16L 1/203; B63B 23/04; B63B 27/02; B63B 27/04; B63B 27/10; B63B 35/03; B63B 35/04; B63B 35/4413; B63B 3/54

USPC ..... 104/101, 102, 134, 135, 48, 96; 114/366, 373, 375; 212/272, 273, 307, 212/308, 309, 310, 311; 246/381, 430; 405/2, 3; 414/137.7, 137.9, 414/138.1–138.4, 138.8, 141.6, 141.7, 414/142.6, 142.7, 142.8, 143.2, 500, 537, 414/538

See application file for complete search history.

(56) References Cited

U.S. PATENT DOCUMENTS

| | | | | |
|---|---|---|---|---|
| 260,924 | A * | 7/1882 | Bacci | 212/83 |
| 1,111,836 | A * | 9/1914 | Johnson et al. | 114/366 |
| 3,341,035 | A * | 9/1967 | Black | 414/142.8 |

(Continued)

FOREIGN PATENT DOCUMENTS

| | | | | |
|---|---|---|---|---|
| GB | 2502379 A | 11/2013 | | |
| WO | WO 2010093251 A1 * | 8/2010 | | B66C 13/04 |

OTHER PUBLICATIONS

Office Action dated Sep. 20, 2014 in Norwegian patent application No. 20131373.

Translation into English of Office Action dated Sep. 20, 2014 in Norwegian patent application No. 20131373.

(Continued)

*Primary Examiner* — Gregory Adams

(74) *Attorney, Agent, or Firm* — Oppedahl Patent Law Firm LLC

(57) ABSTRACT

A method for offshore overboarding a structure on a vessel for subsequent lowering the structure to the sea floor, is using a crane (13) to lift the structure at its storage place on a deck of the vessel and move it by means of the crane to a position free of the vessel before lowering it into the sea. During at least a part of the overboarding movement of the structure (1), the structure (1) is forced to follow a track (2) along the deck of the vessel. Two apparatus for performing the method are also presented.

14 Claims, 10 Drawing Sheets

(56) References Cited

U.S. PATENT DOCUMENTS

| | | | | |
|---|---|---|---|---|
| 3,400,844 | A * | 9/1968 | Overstreet | 414/500 |
| 3,468,437 | A * | 9/1969 | Miller | 414/143.2 |
| 4,582,297 | A * | 4/1986 | Conti | 254/134.3 FT |
| 7,862,255 | B2 * | 1/2011 | Roodenburg et al. | 405/166 |
| 2011/0017695 | A1 * | 1/2011 | Vandenbulcke et al. | 212/279 |
| 2011/0243689 | A1 * | 10/2011 | Pose | 414/137.1 |
| 2014/0069883 | A1 * | 3/2014 | Karp et al. | 212/308 |

OTHER PUBLICATIONS

Norwegian search report in application No. 20131373, dated Sep. 20, 2014.

The different phases of a subsea lift from an offshore construction vessel, presentasjon av Technip, Dec. 2, 2009, for relevant portions see Norwegian search report.

Deck and Subsea operations, presentasjon av Subsea 7, Nov. 30, 2011, for relevant portions see Norwegian search report.

* cited by examiner

Fig. 2
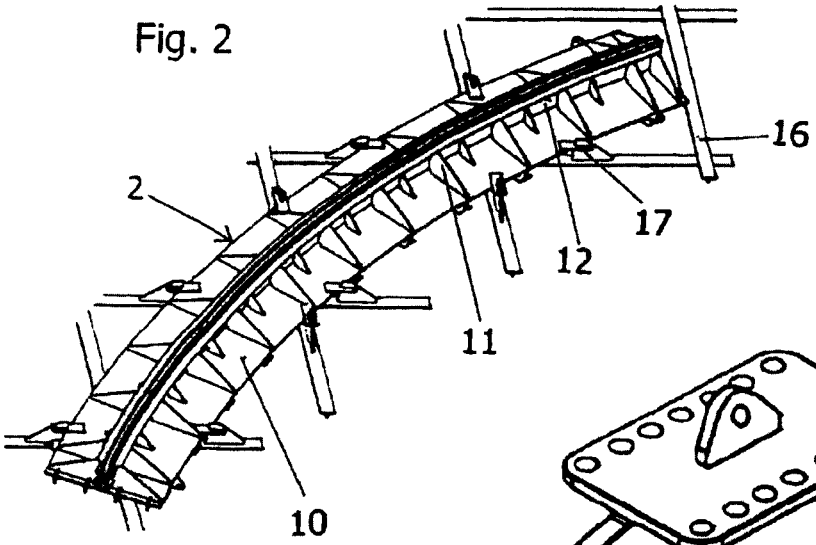
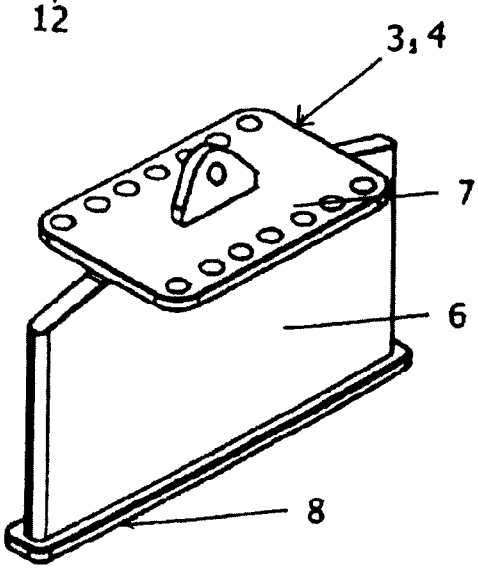
Fig. 3
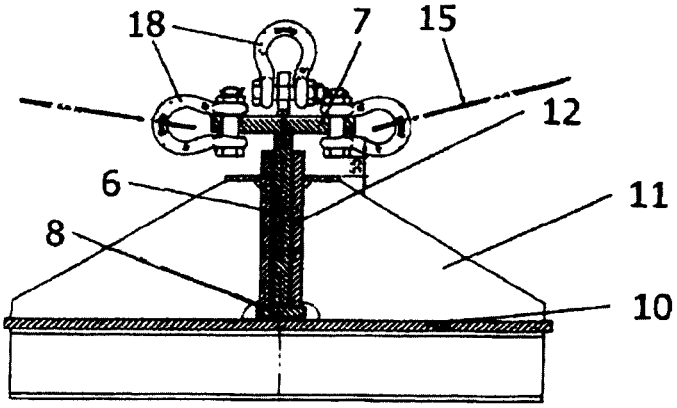
Fig. 4

METHOD AND APPARATUS FOR OVERBOARDING OF A SUBSEA STRUCTURE

The present invention relates to equipment and a method for offshore overboarding of a structure for safe and efficient lifting and maneuvering of the structure over the deck of a surface vessel.

BACKGROUND

Conventional offshore installation methods are normally based on the use of tugger lines directly connecting the structure to winches or handled manually by on-deck personnel. A common challenge for such operations is to obtain adequate control of the movement of the structure and the rotation in particular when the vessel is influenced by wave loads. Especially in situations where the structure is large and there is limited deck space, the overboarding operation is critical due to the risk of clashing of structure into deck equipment. Consequently, the limiting sea state for such operations is often quite low.

A number of constant tension winches, typically five to eight winches, have previously been used to guide and overboard heavy structures. The winches have been arranged such that the structure is guided step by step by a system of winch wires connected between the structure and deck. As the winches at times will pull against each other, wires have ruptured as a result of lack of control due to the complexity of the system.

GB 2502379 A, which was not publically available at the priority date of the present application, shows overboarding a structure by means of a crane while keeping the object stationary with respect to the crane axis by means of telescopic arms extending between the structure and a rotatable ring on the pedestal of the crane. The arms are maintained in compression in order to reduce pendulum movements of the structure caused by ship movements due to the sea state. This system is complicated and cannot easily be decommissioned for use on other vessels. Besides, it cannot be used for unwieldy structures and structures stored outside the relatively short reach of the arms.

SUMMARY OF THE INVENTION

The present invention comprises a method and an apparatus as defined in the appended claims.

With the present invention, the challenges mentioned above are reduced to a large extent. The main reason for this is that the structure is connected to one or more sliders or "sleds" moving along a track or rail which is fixed to the vessel deck. The sled(s) slide along the rail. For large loads, two sleds will often be used, whereby one of the sleds will be connected to one line from each corner of the structure and will be close to the horizontal position of the structure's center of gravity. A second sled will be situated at the tail end and will guide the rotation of the structure. For smaller loads, one sled might be sufficient. The lines attached to the sleds can consist of wire and polyamide slings for shock absorption. The operation starts by lifting the structure off deck with the crane. Then, the crane can start to function and thereby pull the structure along the rail. The sled(s) function as a moving guidance system for the structure. This increases the control of the structure and thereby reduces the risk of undesired structure movements, rotations and excessive forces in any tugger lines. Consequently, the sea-state operability can be increased in some cases.

The guide rail, which is a key part of the invention, is designed in a specific manner dependent on the structure dimensions, crane properties and the deck layout. The main idea is to introduce a rail pattern which shape is fitted for the specific structure geometry. Although the rail design is not limited to a circular pattern, it may be beneficial since it eliminates the need for crane boom in/out when the crane centre corresponds with the centre of curvature of the rail. Straight rails and a combination of straight and curved rails are also included in the invention.

The present invention can be applied on a large variety of offshore construction lifts, such as, but not limited to templates, manifolds, spools, suction anchors regardless of weight and shape. Typically, large and irregularly shaped structures can be handled.

The guide rail is a more safe mechanically passive system, using a track rather than a number of winches to control horizontal movement of the lifted object during over-boarding.

DESCRIPTION OF THE DRAWINGS

For better understanding of the invention, it will be described in more detail with reference to the exemplifying embodiments shown in the appended drawings, wherein FIG. 2 is a perspective view of a section of a track for use in the present invention, FIG. 3 is a perspective view of a slider for use with the track of FIG. 2, FIG. 4 is a vertical cross section of an assembly of the track in FIG. 2 and the slider in FIG. 3.

DETAILED DESCRIPTION

Figure 1:
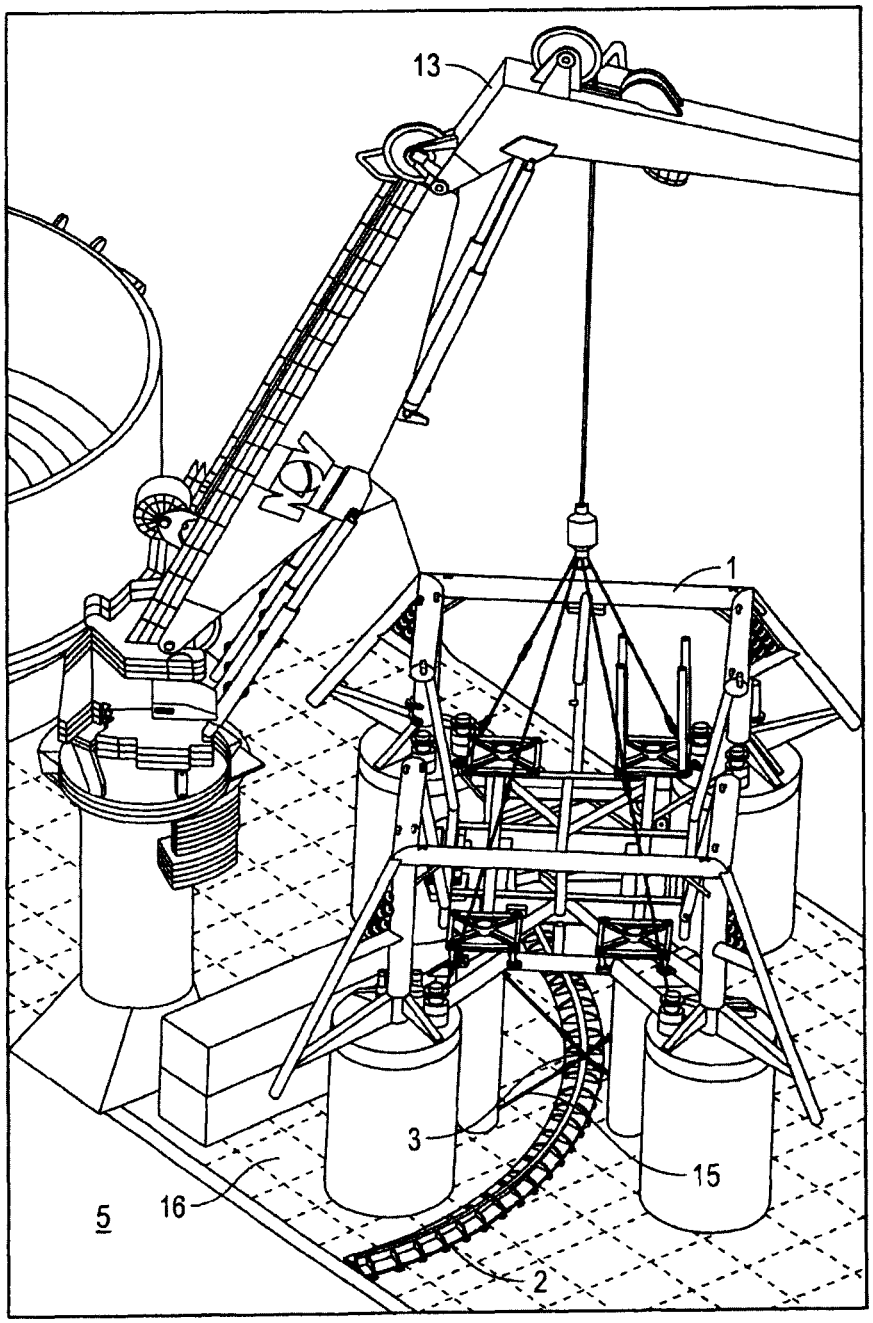
FIG. 1 shows is a perspective view showing a first structure suspended in a crane.

FIG. 1 shows a first structure 1, such as a subsea template, on the deck 16 of a surface vessel suspended in a crane 13. The structure is straddling a track or rail 2 welded to the deck 16 of the vessel. The structure 1 is seen connected by means of lines 15 to a slider or sled 3 which can slide in the rail 2. Hidden from view is a second sled 4 connected at a peripheral position of the structure 1.

FIG. 2 shows a segment of the rail 2. As also show in the cross section of FIG. 4, the rail comprises two curved, vertically oriented parallel plates 12 with a slot between them. These plates are held in position above a base plate 10 by brackets 11 which are welded to the base plate 10 and the respective plate 12, leaving a gap between the lower edges of the parallel plates 12 and the base plate 10. FIG. 2 also shows further brackets 17 which keep the rail fixed to the deck 16.

FIG. 3 shows details of the slider or sled 3, 4. It comprises a vertical plate 6 that will fit glidingly in the slot between the parallel plates 12 of the rail 2. It further has a top plate 7 with holes for line connections, and a bottom plate 8 to fit in the gap between the lower edges of the parallel plates 12 and the base plate 10 and hold the sled captive in the rail 2. The vertical plate 6 may be slightly curved to fit the curvature of the rail 2.

In addition, FIG. 4 shows shackles 18 for connecting tension lines 15 to the sled.

Figure 5:
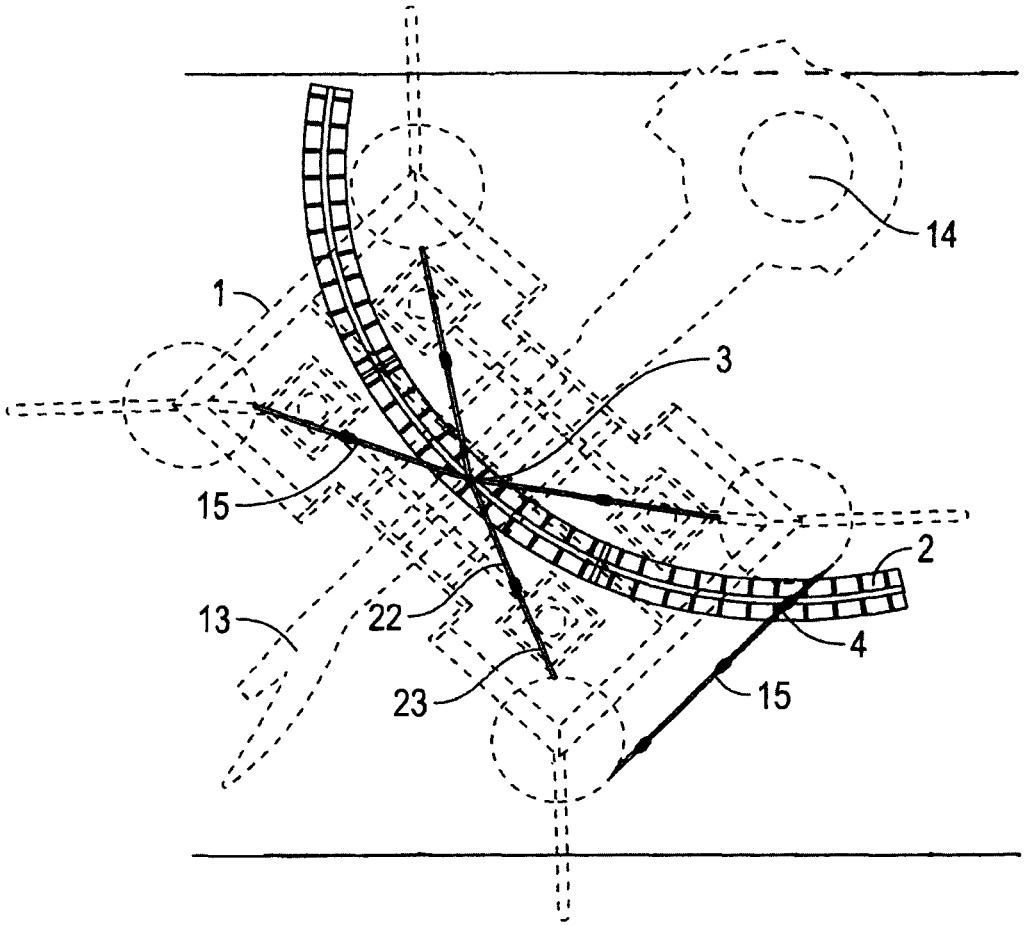
FIG. 5 is a plan view, partly in phantom lines, of the arrangement of FIG. 1 in a first position.

FIG. 5 shows the layout of the rail 2 on the deck of the vessel and the position of the sleds 3, 4 and lines 15, with the structure 1 and crane 13 shown only in phantom lines for clarity. The lines 15 comprise wire and polyamide slings 22, 23 for shock absorption. The rail 2 comprises three of the segments shown in FIG. 2.

Figure 6:
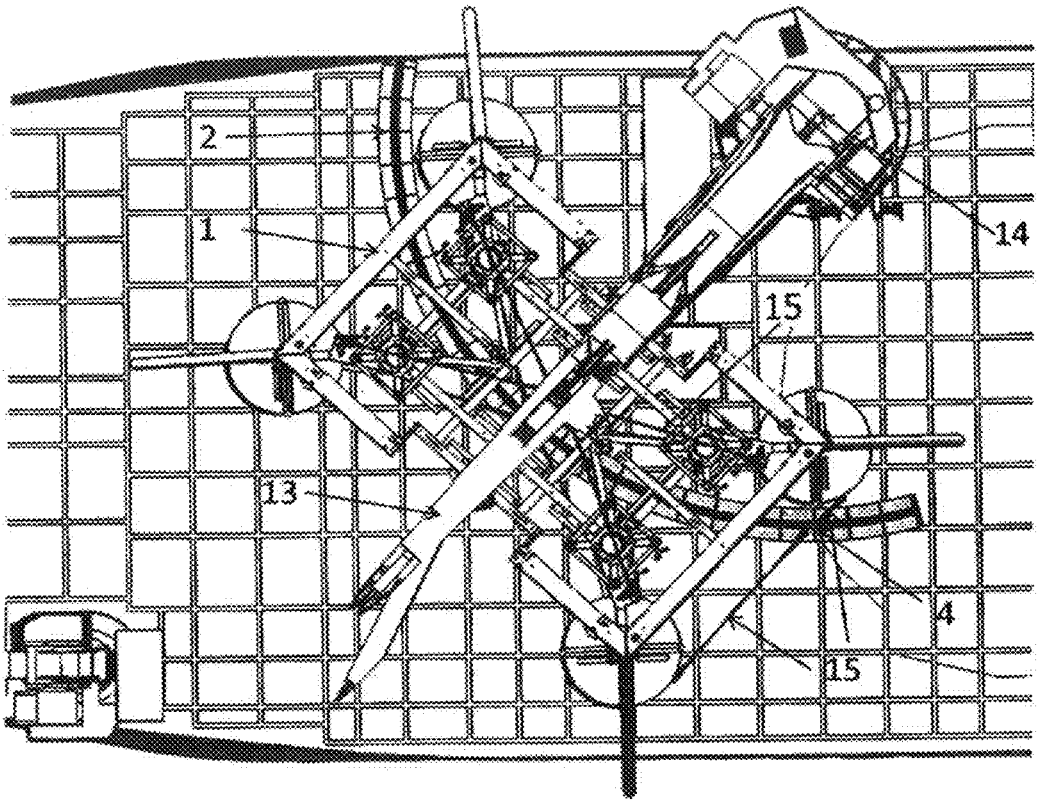
FIG. 6 is a plan view like FIG. 5 in solid lines.

In FIG. 6, the structure 1 is in the starting position where it is lifted off deck with wires connecting the crane 13 to top of structure. The bottom of the structure 1 is connected to the rail sleds 3, 4 with lines 15. There are two sleds, one 4 is situated aft of the structure, whereas the other 3 is below the center (not visible on this figure). The sleds are designed such that they slide smoothly within the rail 2. The curvature of the rail 2 is designed to have its center of curvature on or close to the stewing axis 14 of the crane, such that the crane only needs to slew around its center and not change the boom angle in order to maneuver the structure off deck.

For this particular structure 1, the large size relative to available deck space creates a high demand on accuracy in the positioning of the structure during the over boarding operation. The guide rail system provides a passive positioning and rotation control during the overboard phase.

Figure 7:
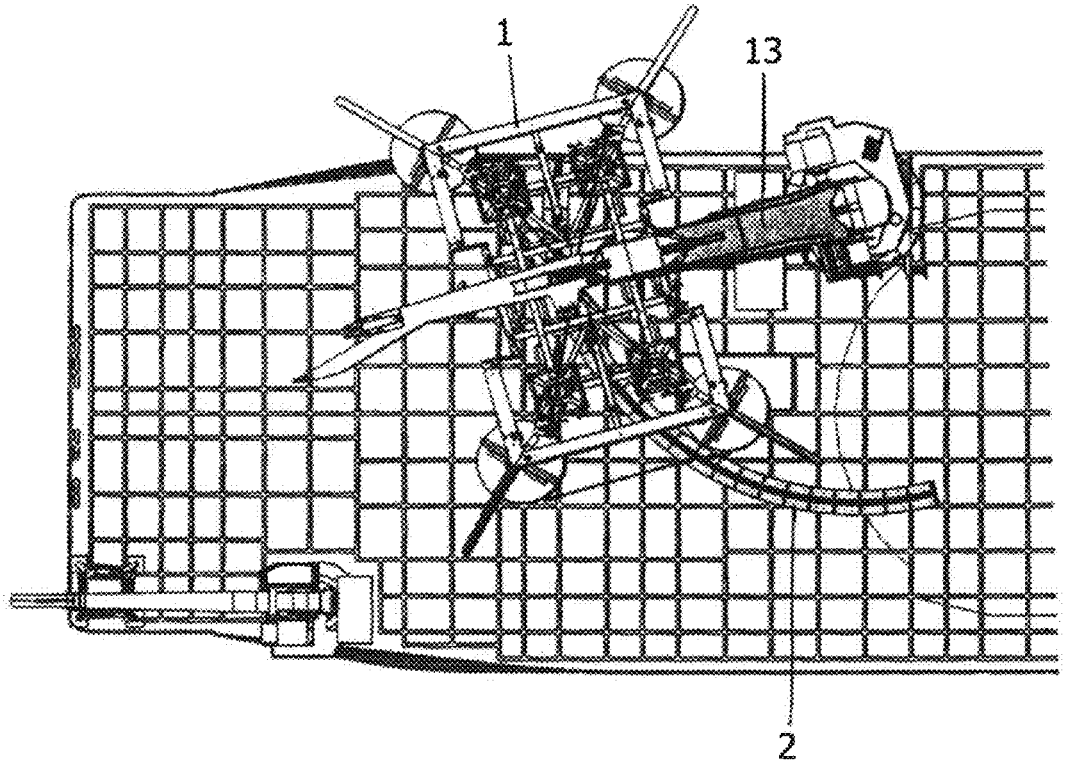
FIG. 7 is a plan view like FIG. 6 with the first structure in a second position.

FIG. 7 shows the structure 1 half way from starting position to the deployment position outside the vessel hull 5. The crane 13 is slewing slowly while the lines 15 connecting the structure 1 to the rail sleds 3, 4 insure passive position and rotation control of the structure.

As the slewing continues, the sleds 3, 4 will eventually leave the rail 2 as the structure 1 comes clear of the deck 16. In this situation, the orientation of the structure is controlled by lines from tugger winches on deck. Subsequently, the structure is lowered into the water, with the sleds 3, 4 hanging in their lines 15. When the structure 1 has reached a suitable depth, the crane 13 is set to heave compensation, and tugger lines and sleds are disconnected from the structure 1 by an ROV and retrieved to the vessel.

Figure 8:
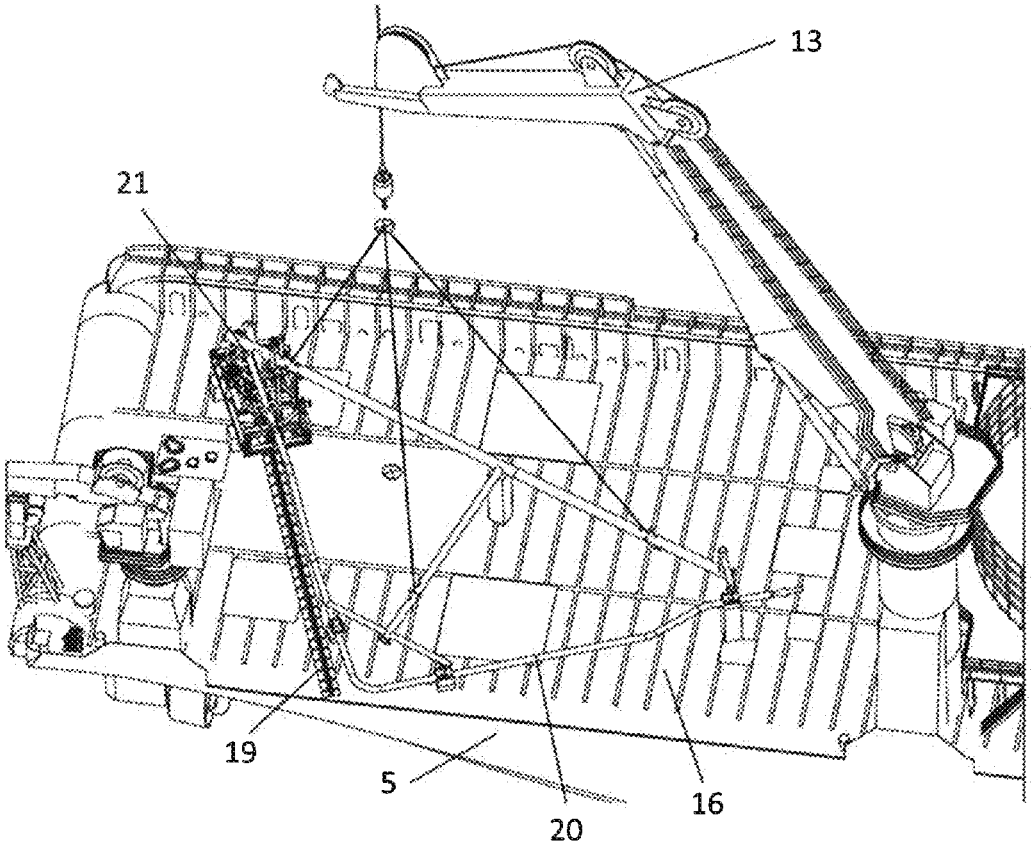
FIG. 8 is a perspective view of a second structure in a first position suspended in a crane.

FIG. 8 shows a second structure 20, here a spool connected to a squared termination device 21, on the deck 16 of a surface vessel, suspended in a crane 13 in a first position. The structure is located substantially to one side of a track or rail 19 welded or in other ways attached to the deck 16 of the vessel.

Figure 9:
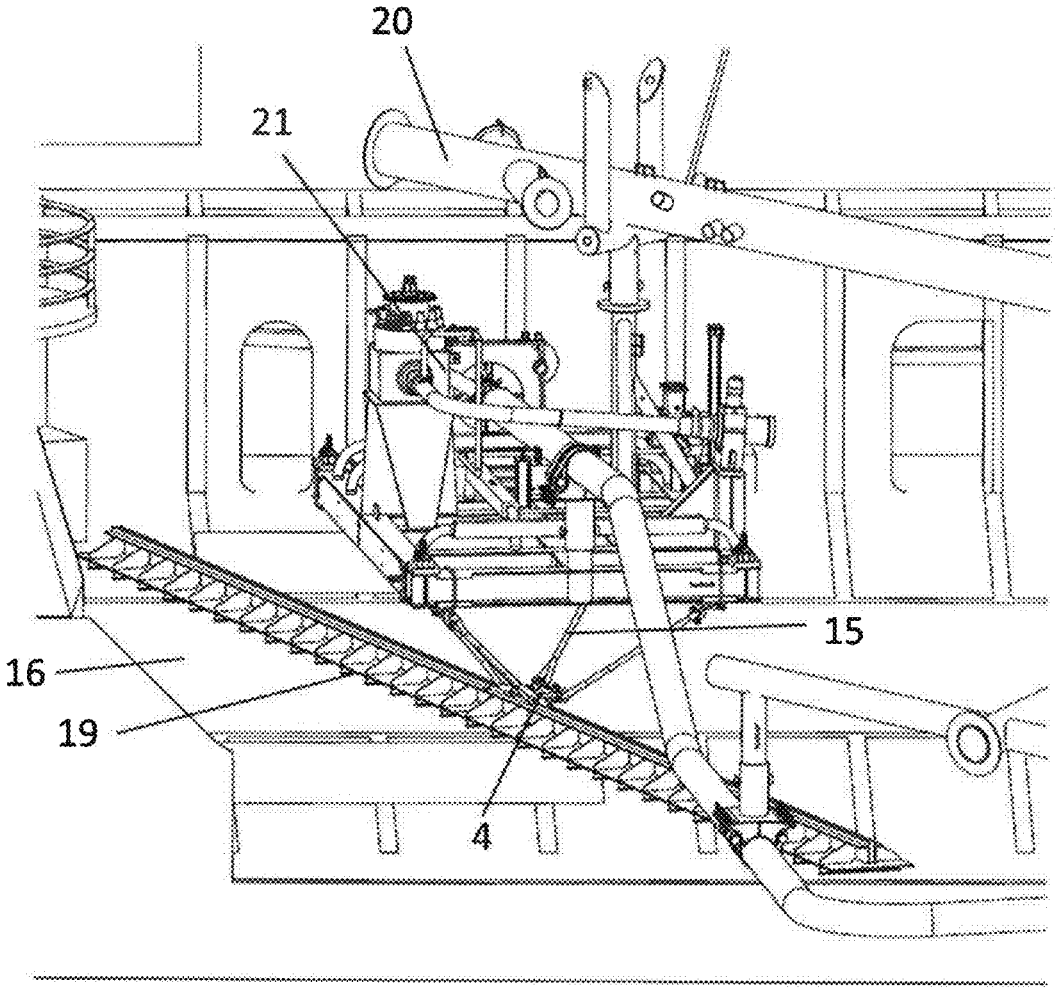
FIG. 9 is a perspective view at a larger scale of parts of the second structure in FIG. 8 in a second position.

FIG. 9 shows the structure 20 in a second position, lifted off deck 16 with the crane 13. The structure is connected by lines 15 to a sled 4, which is gliding in the rail track 19 attached firmly to the vessel deck 16.

In FIG. 8, the structure 20 is in the starting position, where it is lifted off deck with wires connecting the crane 13 to top of structure. The bottom of the structure 20, at the end termination device 21, is connected to the rail sled 4 with lines 15, as shown in FIG. 9. There is only one sled, which is situated aft at the trailing end of the structure. The sled is designed such that it slides smoothly within the rail 19. The path of the rail 19 is designed for optimal guidance of structure 20 over the deck 16 with respect to clearance to other deck structures.

For this particular structure 20, the large size relative to available deck space creates a high demand on accuracy in the positioning of the structure 20 during the overboarding operation. The guide rail system provides a passive positioning control during the overboard phase.

Figure 10:
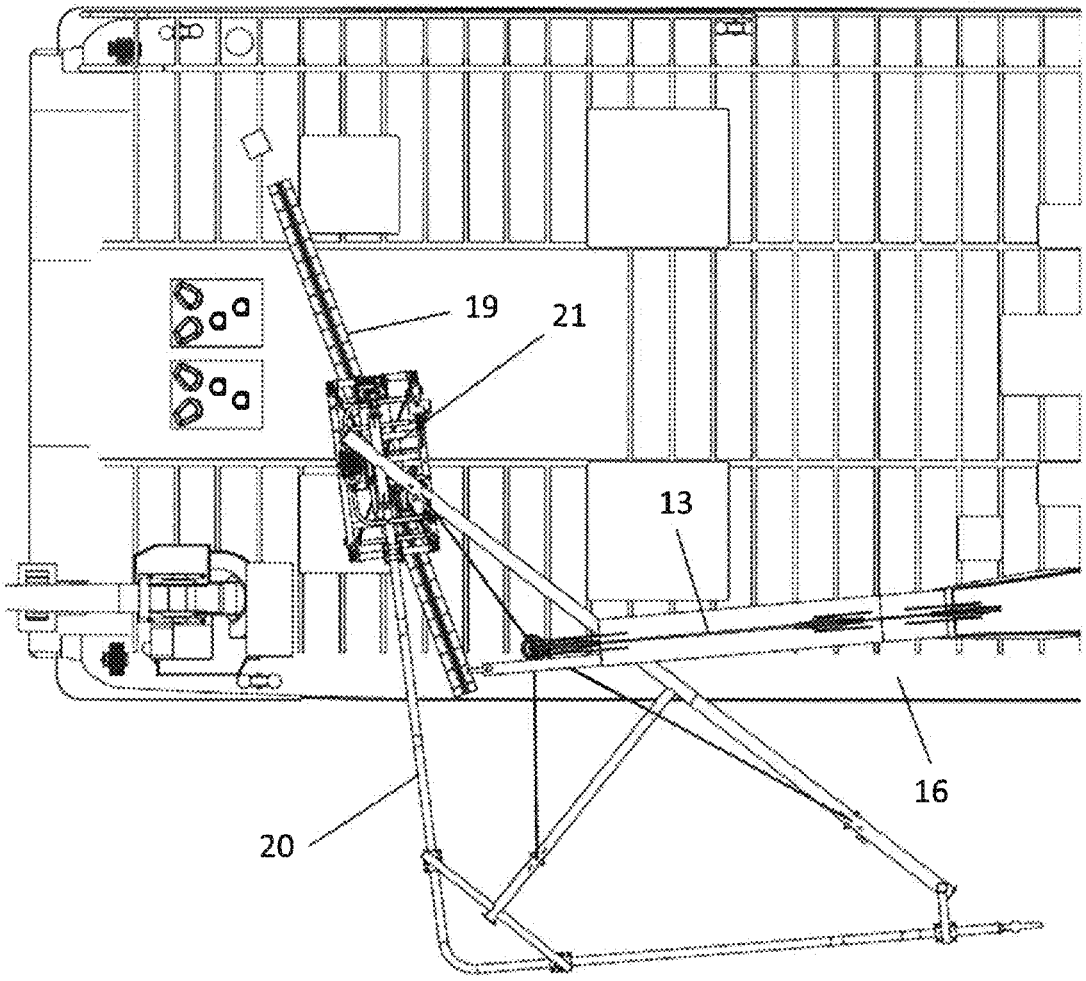
FIG. 10 is a plan view of the second structure in the second position.

FIG. 10 shows the structure 20 in the second position in FIG. 9, half way from the starting position to the deployment position outside the vessel hull 5. The crane 13 is moving slowly in the direction of the track 19 while the lines 15 connecting the structure 20 to the rail sled 4 insure passive position control of the structure 20.

Figure 11:
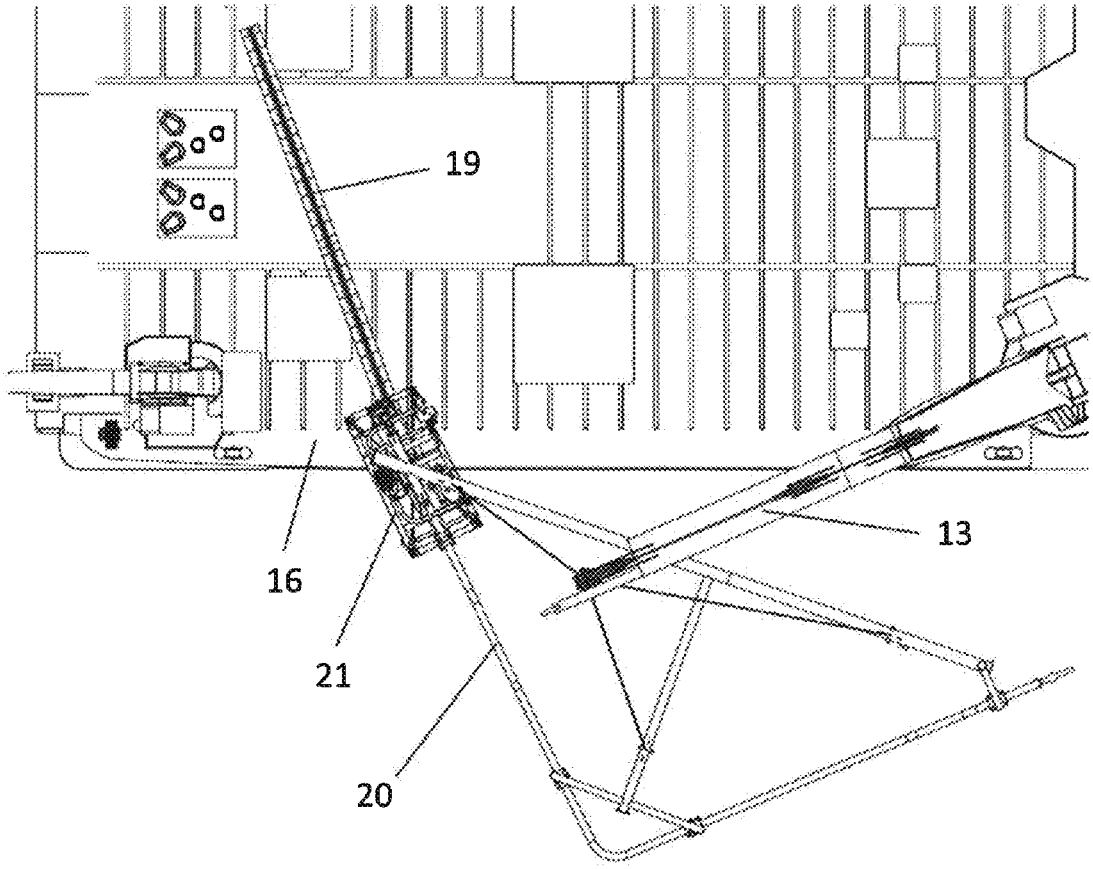
FIG. 11 is a plan view like FIG. 10 with the second structure in a third position.
Figure 12:
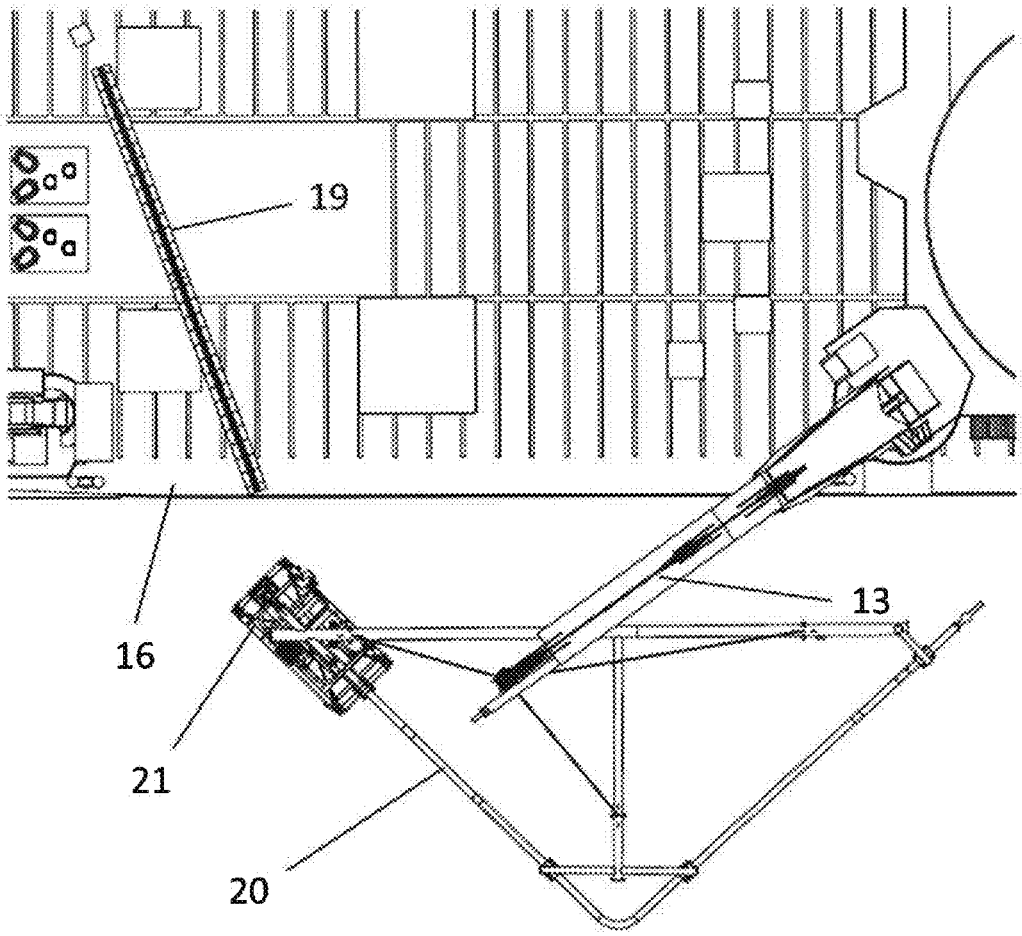
FIG. 12 is a plan view like FIG. 10 with the second structure in a fourth position.

FIG. 11 shows the structure 20 in a third and final position before leaving the vessel deck 16. As the moving of the crane continues, the sled 4 will leave the rail 19 as the structure 20 comes clear of the deck 16. In this situation, which is shown in FIG. 12, the orientation of the structure 20 is controlled by lines from tugger winches (not shown) on deck. Subsequently, the structure is lowered into the water, with the sled 4 hanging in its lines 15. When the structure 20 has reached a suitable depth, the crane 13 is set to heave compensation, and tugger lines and the sled are disconnected from the structure 20 by an ROV and retrieved to the vessel.

It will be understood that the invention is not limited to the exemplifying embodiment described above, but can be varied and modified by the skilled person within the scope of the following claims. For example, the track can take various forms, such as that of a railroad rail. In this case, the slider could take the form of a trolley straddling the head of the rail and having wheels or other low friction elements engaging under either side of the head. Furthermore, the track can easily be removed from the deck of the vessel after completion of the overboarding operation, e.g. for use on another or the same vessel on a later occasion. For ease of handling and storage, the track may be built in manageable sections, which are joined together in a suitable manner, e.g. with a pin and socket connection, during installation on the deck.

The invention claimed is:

1. An apparatus for controlling the movement of a structure (1, 20) during offshore overboarding of the structure from a vessel (5), the overboarding comprising moving the structure by means of a crane (13) from a storage place on the deck (16) of the vessel to a position free of the vessel for lowering it into the sea, wherein the apparatus comprises a track (2,19) arranged on the deck (16) of the vessel and at least one runner (3,4) held captive on the track while being movable along the track, the track (2,19) extending from the storage place of the structure (1,20) to a side area of the vessel, said at least one runner (3,4) being connected to the structure by tension means (15) while the structure is suspended above the track and runner by the crane.

2. The apparatus according to claim 1, wherein the track (2,19) is one of straight (19), curved (2) and a combination of both (2,19).

3. The apparatus according to claim 1, wherein there are at least two runners (3,4), whereof one (3) is connected to the structure (1) in a central area thereof and another (4) is connected to the structure (1,20) in a peripheral area thereof.

4. The apparatus according to claim 1, wherein the track (2) is semicircular and has its center of curvature at or near a slewing axis (14) of the crane (13).

5. The apparatus according to claim 1, wherein there is one runner (4) connected to the part (21) of the structure (20) which forms the trailing part thereof during the overboarding movement.

6. The apparatus according to claim 1, wherein the track (2,19) comprises two vertically oriented parallel plates (12) with a slot between them, the parallel plates (12) being held in position above a base plate (10) by brackets (11) welded to the base plate (10) and the respective parallel plate (12), leaving a gap between the lower edges of the parallel plates (12) and the base plate (10), the slot between the parallel plates (12) and the gap below the parallel plates (12) receiving respective parts (6, 8) of said at least one runner (3, 4).

7. The apparatus according to claim 6, wherein a portion of the runner (3, 4) received in the slot between the parallel plates (12), extends above the parallel plates (12) and carries an anchorage point (7) for the tension means (15).

8. The apparatus according to claim 1, wherein the tension means (15) comprises a wire and a polyamide sling.

9. A method for offshore overboarding a structure (1,20) on a vessel (5) for subsequent lowering of the structure to the sea floor, the vessel having a crane (13) having a boom and a slewing axis (14), the method comprising:

lifting the structure from a storage place on a deck (16) of the vessel (5) using the crane (13);

moving the structure using the crane (13) to a position free of the vessel before lowering the structure into the sea;

wherein during at least a part of the step for moving the structure, guiding a movement of the structure using a track (2,19) along the deck (16) of the vessel.

10. The method according to claim 9, wherein the step for guiding the movement of the structure is performed using the track (2,19) having a shape chosen from one of straight, curved, and a combination of both shapes.

11. The method according to claim 9, wherein prior to the step for guiding the movement of the structure, attaching the track to the deck (16) of the vessel (5), the track comprising a rail arrangement (2,19).

12. The method according to claim 9, wherein the guiding step further comprises guiding the movement of the structure along a semi-circular path, the track (2) having a semi-circular shape, a center of curvature of the track coinciding substantially with the slewing axis of the crane (13).

13. The method according to claim 9, wherein the guiding step further comprises guiding the structure (20) along a straight path, the track (19) having a straight shape.

14. The method according to claim 9, further comprising maintaining the structure (1,20) in a position with respect to the track (2,19) using at least one moveable connection point (3,4).

* * * * *